US009856806B2

(12) United States Patent
Bjurman

(10) Patent No.: US 9,856,806 B2
(45) Date of Patent: Jan. 2, 2018

(54) INTERNAL COMBUSTION ENGINE AND A METHOD FOR CONTROLLING AN INTERNAL COMBUSTION ENGINE

(71) Applicant: VOLVO CONSTRUCTION EQUIPMENT AB, Eskilstuna (SE)

(72) Inventor: Magnus Bjurman, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 15/038,650

(22) PCT Filed: Nov. 29, 2013

(86) PCT No.: PCT/SE2013/000187
§ 371 (c)(1),
(2) Date: May 23, 2016

(87) PCT Pub. No.: WO2015/080633
PCT Pub. Date: Jun. 4, 2015

(65) Prior Publication Data

US 2016/0298557 A1 Oct. 13, 2016

(51) Int. Cl.
*F02D 41/00* (2006.01)
*F02D 17/02* (2006.01)
(Continued)

(52) U.S. Cl.
CPC ..... *F02D 41/0055* (2013.01); *F02D 17/02* (2013.01); *F02D 21/08* (2013.01);
(Continued)

(58) Field of Classification Search
CPC ..... F02D 41/0055; F02D 41/0082; F02D 41/0087; F02D 17/02; F02D 17/023; F02D 21/08; F02M 26/43; F02M 26/64
(Continued)

(56) References Cited

U.S. PATENT DOCUMENTS 4,201,180 A * 5/1980 Iizuka ..... F02D 17/02 123/481
4,231,338 A * 11/1980 Sugasawa ..... F02D 17/02 123/198 F
(Continued)

FOREIGN PATENT DOCUMENTS

DE 102004032589 A1 2/2006
DE 202013102075 U1 6/2013
(Continued)

OTHER PUBLICATIONS

International Search Report (dated Sep. 15, 2014) for corresponding International App. PCT/SE2013/000187.
(Continued)

*Primary Examiner* — Mahmoud Gimie
(74) *Attorney, Agent, or Firm* — WRB-IP LLP

(57) ABSTRACT

An internal combustion engine has a plurality of cylinders and is provided with an arrangement for exhaust gas recirculation. The plurality of cylinders is divided into a first group and a second group of cylinders. The internal combustion engine further has a control device arranged to provide a heating mode of the internal combustion engine where the first group cylinders are deactivated and the second group cylinders are activated. The control device is arranged to provide a higher proportion recirculated exhaust gas than inlet air to the first group cylinders in the heating mode.

17 Claims, 4 Drawing Sheets

(51) Int. Cl.
*F02D 21/08* (2006.01)
*F02M 26/43* (2016.01)

(52) U.S. Cl.
CPC ..... *F02D 41/0082* (2013.01); *F02D 41/0087* (2013.01); *F02M 26/43* (2016.02)

(58) Field of Classification Search
USPC ..... 123/568.11, 698, 681, 198 F, 481
See application file for complete search history.

(56) References Cited

U.S. PATENT DOCUMENTS 4,303,053 A * 12/1981 Etoh ..... F02D 17/02 123/198 F
4,304,208 A * 12/1981 Etoh ..... F02D 17/02 123/198 F
4,316,438 A * 2/1982 Iizuka ..... F02D 17/02 123/198 F
4,344,393 A 8/1982 Etoh et al.
4,345,571 A * 8/1982 Iizuka ..... F02D 17/02 123/198 F
4,365,597 A * 12/1982 Iizuka ..... F02D 17/02 123/198 F
4,366,788 A * 1/1983 Tanaka ..... F01M 13/02 123/198 F
4,391,240 A * 7/1983 Sugasawa ..... F02D 17/02 123/198 F
8,091,340 B2 1/2012 Ranini et al.

FOREIGN PATENT DOCUMENTS

FR 2916245 A3 11/2008
GB 2047800 A 12/1980
JP S56162238 A 12/1981
JP S59148450 U 10/1984

OTHER PUBLICATIONS

International Preliminary Report on Patentability (dated Nov. 27, 2015) for corresponding International App. PCT/SE2013/000187.
European Official Action (dated Jul. 13, 2017) for corresponding European App EP 13 89 8211.

* cited by examiner

INTERNAL COMBUSTION ENGINE AND A METHOD FOR CONTROLLING AN INTERNAL COMBUSTION ENGINE

BACKGROUND AND SUMMARY

The invention relates to an internal combustion engine having a control device arranged to provide a heating mode of the internal combustion engine, and a method for controlling an internal combustion engine.

The invention is applicable on different types of vehicle and engine, in particular working machines within the fields of industrial construction machines and construction equipment, such as wheel loaders and articulated haulers. Although the invention will be described with respect to a wheel loader, the application of the invention is not restricted to this particular machine, but may also be used in other vehicles, such as trucks and buses for instance.

It is difficult to warm up a diesel engine running in a low load operation, particularly in a cold environment. The use of an engine having a low temperature will increase the fuel consumption and the wear of the engine. In addition, the exhaust gas temperature will also be low and that makes an exhaust aftertreatment system ineffective or not usable at low load.

In order to solve the problems related to a low exhaust gas temperature some engines have certain operation modes for rapidly raising the exhaust gas temperature of the engine and thereby enabling the use of exhaust aftertreatment system, such as Selective Catalytic Reduction (SCR).

Document U.S. Pat. No. 8,091,340 discloses a method of controlling the intake of an internal combustion engine where a greater proportion of the total feed is admitted into one group of cylinders than in another group of cylinders to achieve an increased exhaust gas temperature. During some operation conditions the efficiency of this method is however not sufficient and/or the method involves an increased fuel consumption.

It is desirable to provide an internal combustion engine and a method where the engine temperature as well as the exhaust gas temperature can be raised in an efficient way during a heating mode.

By the provision of an internal combustion engine having a plurality of cylinders, where the internal combustion engine is provided with an arrangement for exhaust gas recirculation, and the plurality of cylinders are divided into a first group and a second group of cylinders, and the internal combustion engine has a control device arranged to provide a heating mode of the internal combustion engine where the first group cylinders are deactivated and the second group cylinders are activated, and in the heating mode the control device is further arranged to provide a higher proportion recirculated exhaust gas than inlet air to the first group cylinders, the engine can be run with a reduced amount of excessive air.

By the definition that the first group cylinders will be deactivated is meant that these cylinders are non-firing cylinders in the heating mode. Accordingly there is not any fuel introduced into the first group cylinders (or only a negligible fuel amount not sufficient to achieve ignition of the gas in the cylinder is introduced). Thus, while not increasing the total fuel consumption an increased amount of fuel can be introduced into the activated second group cylinders, i.e. the working cylinders or firing cylinders, to rapidly increase the temperature and maintain the engine load.

The invention is based on the insight that excessive air flow (very high lambda) at low engine load will act as a cooler on the engine, in particular on the non-firing cylinders, and will counteract an increased exhaust gas temperature.

By the provision of a higher proportion recirculated exhaust gas than inlet air to the first group cylinders in the heating mode, the cold air mass flow through the engine can be significantly reduced. This will give increased exhaust temperature and heat input to the engine cooling system and will decrease the requisite time for achieving the desired engine and exhaust temperatures. Although the cylinders could be controlled individually, in the heating mode the control device is preferably arranged to provide a higher proportion recirculated exhaust gas than inlet air to each cylinder of the first group cylinders. In other words; for each first group cylinder the amount of recirculated exhaust gas is more than 50% of the total gas volume introduced into the cylinder and the amount of inlet air is less than 50% of the total gas volume introduced into the cylinder.

This in turn will reduce the fuel consumption due to a decreased idle time and less friction between the engine components. Normal engine temperature can be maintained at colder climate. Other less fuel efficient warm up methods (heat modes) can be avoided. These other methods often depend on throttling of the gas flow at the inlet or exhaust side, or on reduction of the expansion work by either phasing the heat release later or opening the exhaust valve earlier.

Furthermore, the use of a NOx agent as urea solution is possible also at low load or idle operation with reduced risk of crystallization. By a higher idle temperature the light-off temperature of a Diesel Oxidation Catalyst (DOC) can be achieved faster. Also regeneration of soot-filter could be possible at idle operation if the temperature is increased.

According to a preferred embodiment of the invention, in the heating mode the control device is arranged to provide more than 60% recirculated exhaust gas and less than 40% inlet air to the first group cylinders, suitably more than 70% recirculated exhaust gas and less than 30% inlet air, and preferably more than 80% recirculated exhaust gas and less than 20% inlet air, and more preferably more than 90% recirculated exhaust gas and less than 10% inlet air, and most preferably more than 95% recirculated exhaust gas and less than 5% inlet air to the first group cylinders. Hereby the heating of the engine can be performed with very high efficiency.

Ideally the control device is arranged to stop the inlet air flow to the first group cylinders and to provide substantially only recirculated exhaust gas to the first group cylinders in the heating mode, i.e. the amount of recirculated exhaust gas introduced into the respective cylinder of the first group cylinders is preferably substantially 100% of the total gas volume introduced into the cylinder.

According to a further preferred embodiment of the invention, where the control device comprises a valve for limiting or preventing a flow of inlet air to the first group of cylinders while allowing a flow of inlet air to the second group of cylinders in the heating mode, and preferably where the internal combustion engine has an inlet air manifold for providing air to the plurality of cylinders and said valve for limiting or preventing a flow of inlet air to the first group of cylinders is arranged inside the inlet air manifold for dividing the cylinders into the first group and second group of cylinders, a non-complicated, compact and cost efficient design of the engine can be obtained.

According to a further embodiment of the invention, where the internal combustion engine has a cooler for cooling the recirculated exhaust gas before the recirculated exhaust gas is introduced into the first group cylinders in the heating mode, the temperature of the exhaust gas can be controlled to optimize the heating of the engine without introducing gas having such a high temperature that the cylinders could be damaged.

The invention is preferably applied to an internal combustion engine that normally has a great excess of air (high lambda), particularly at low engine load, since the effect of the invention is very significant when applied to these engines. Accordingly, the engine is preferably a compression-ignition engine, such as a diesel engine, though the invention can also be applied to other kinds of engine, such as for example Otto cycle lean burn engines.

According to a further aspect, the invention also relates to a method for controlling an internal combustion engine according to claim 14. The same advantages as discussed above with reference to the internal combustion engine can be reached by the method according to the invention.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
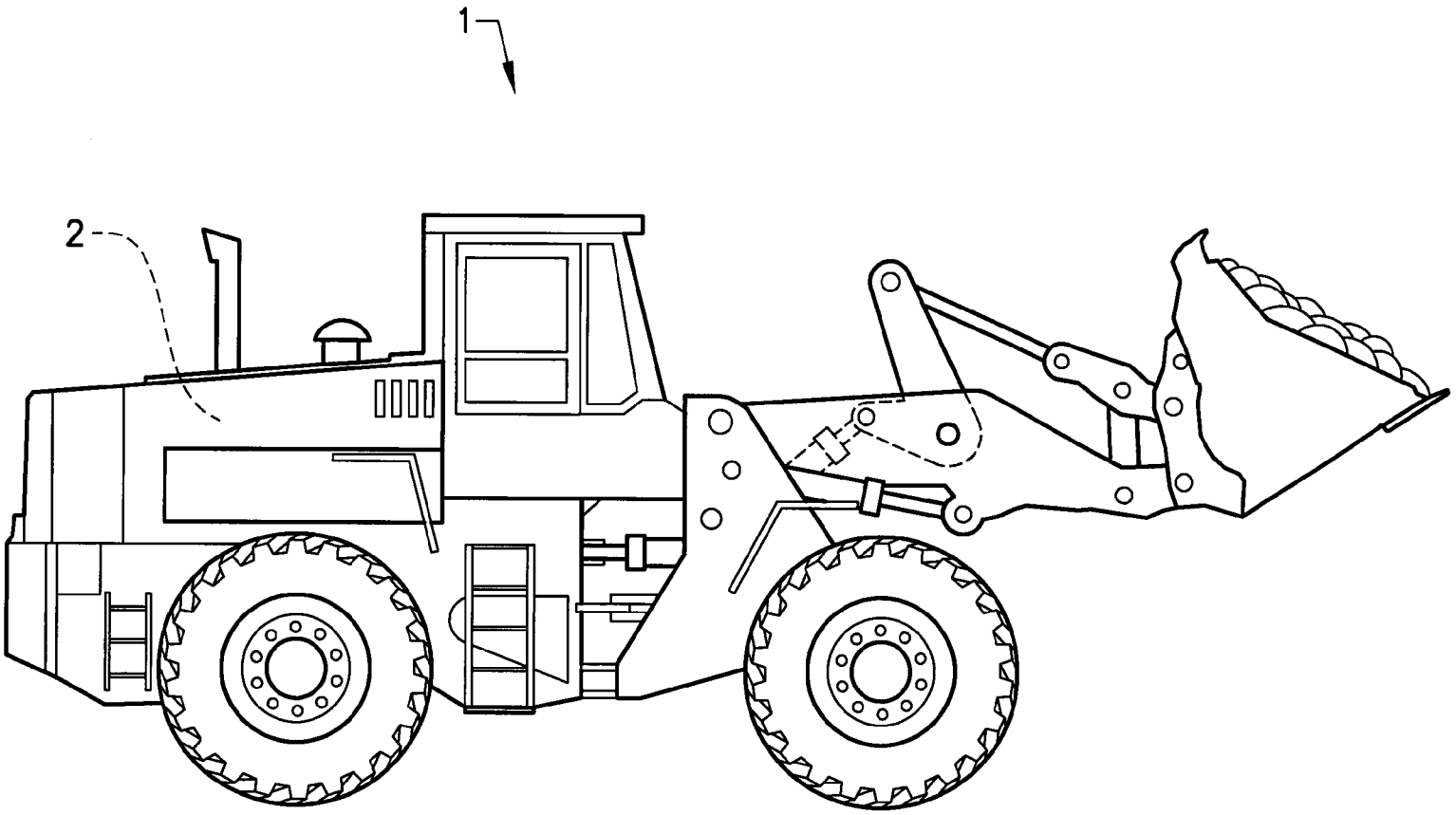
FIG. 1 is a lateral view of a wheel loader provided with an internal combustion engine according to the invention.

FIG. 1 shows a working machine in the form of a wheel loader 1. The wheel loader is to be considered as an example of a vehicle to which the invention can be applied. The wheel loader is provided with an internal combustion engine (ICE) 2 according to the invention. The internal combustion engine is shown and explained below with reference to FIG. 2*a*.

Figure 2A:
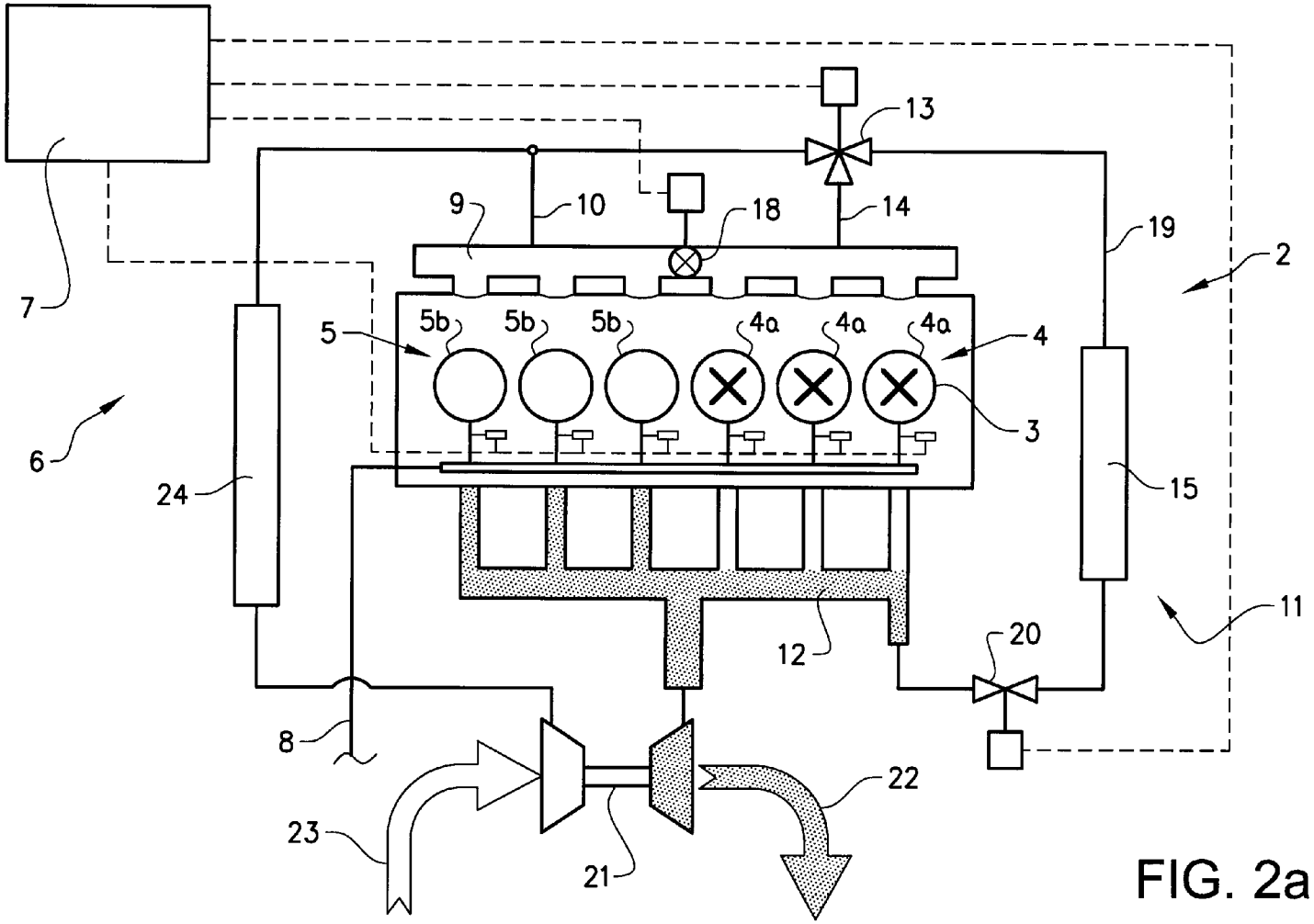
FIG. 2*a* is a schematic view of an internal combustion engine according to the invention.

FIG. 2*a* shows in a schematic view one embodiment of the internal combustion engine 2 according to the invention. The ICE is preferably a compression-ignition engine, such as a diesel engine, though the invention can also be applied to Otto engines. The invention is particularly useful for engines with high air to fuel ratio at low load (high lambda), such as diesel engines, spark-ignited lean-burn Otto cycle gas engines, dual-fuel gas engines using diesel for ignition, etc. A compression-ignition engine is usually run with a very high air to fuel ratio, at least at low load since the engine is lowering the engine load by reducing the amount of fuel injected while not reducing the inlet air flow in proportion.

The ICE has a plurality of cylinders 3. The number of cylinders can be varied, but in this particular embodiment the ICE has six cylinders 3 and these cylinders are divided into two groups; a first group 4 and a second group 5. The number of cylinders that belongs to the first group and to the second group, respectively, can be varied and adapted to a specific engine/engine mode. The number of cylinders in the first group can be in the range from 1 to n−1 if the total number of cylinders of the engine is n, where n≥2. In the illustrated example embodiment showing the 6-cylindric engine, the first group 4 has three cylinders 4*a* and the second group 5 has three cylinders 5*b*.

The internal combustion engine 2 further has a control device 6 arranged to provide a heating mode of the internal combustion engine 2 where the first group 4 cylinders are deactivated and the second group 5 cylinders are activated. By means of the control device 6, the injection of fuel to the first group 4 of cylinders can be stopped during the heating mode. The control device 6 can comprise a control unit 7 and a fuel injection means 8 controlled by means of the control unit 7. The control unit 7 can be a separate unit or a part of another control unit used for controlling other functions of the internal combustion engine 2. The fuel injection means 8 is designed in a way allowing the fuel distribution to the first group 4 of cylinders to be cut at the same as fuel can be distributed to the second group 5 of cylinders, and preferably the fuel injection means 8 is designed for individual control of the injection of fuel for each cylinder. The fuel injection means can be any suitable already existing fuel injection means and is only schematically illustrated in FIG. 2*a*.

In this example embodiment, the engine can be operated as 3-cylinder engine having 240° fire intervals in the heating mode.

The control device 6 is preferably arranged to increase the injection of fuel to the second group 5 of cylinders in the heating mode in comparison to a mode where all cylinders are working cylinders. Advantageously, the injection of fuel to the second group 5 of cylinders is increased by an amount substantially equal to the amount by which the injection of fuel to the first group 4 of cylinders is reduced in the heating mode. For example, when the fuel injection is stopped for half of the cylinders the fuel provided to the firing cylinders can be doubled. In other words; the load on the engine in the heating mode can be equal to the load when not in the heating mode during corresponding conditions by an increased injection of fuel into the working cylinders.

In the heating mode, the control device 6 is also arranged to provide a higher proportion recirculated exhaust gas than inlet air to the first group 4 cylinders.

For this reason the control device is preferably arranged to heavily reduce the inlet air flow to the first group of cylinders in comparison to a mode where all cylinders are working cylinders or in an extreme case stop the inlet air flow to the first group of cylinders.

According to the embodiment illustrated in FIG. 2*a* the control device 6 comprises a valve 18, hereinafter also called air valve 18, for limiting or preventing the flow of inlet air to the first group 4 of cylinders while allowing a flow of inlet air to the second group 5 of cylinders in the heating mode. The internal combustion engine has an inlet air manifold 9 for providing air to the plurality of cylinders, and said air valve 18 is arranged inside the inlet air manifold 9. Thereby the cylinders are physically divided into the first and second group of cylinders (with respect to the inlet air) by means of the air valve 18. An inlet air intake of the inlet air manifold 9 is arranged at the side (left side in FIG. 2*a*) of the air valve 18 where the cylinders 5*b* of the second group 5 of cylinders are arranged. The inlet air is thus introduced into the inlet manifold 9 at this side of the air valve 18, and by controlling (closing) the air valve 18 the air flow to the cylinders 4*a* of the first group 4 of cylinders can be limited or cut, whereas the air flow to the cylinders 5*b* of the second group 5 of cylinders can be maintained. Additionally, the flow to the second group cylinders could also be controlled by any other means. Thus, the air flow to the second group cylinders can be regulated in a conventional way.

The ICE is also provided with an arrangement 11 for exhaust gas recirculation (EGR). In the illustrated embodiment in FIG. 2*a*, an exhaust outlet manifold 12 of the engine is connected to the air inlet manifold 9 by means of a pipe 19. The exhaust outlet manifold 12 can be connected to the air inlet manifold 9 via an EGR-cooler 15 and a valve 13, hereinafter called EGR valve 13. In accordance with the embodiment illustrated in FIG. 2*a*, the control device 6 comprises the EGR valve 13. An EGR intake 14 of the inlet air manifold 9 is arranged at the side (right side in FIG. 2*a* and opposite to the inlet air intake) of the air valve 18 where the cylinders 4*a* of first group 4 of cylinders are arranged. The EGR-cooler 15 can be used for cooling the recirculated exhaust gas before the recirculated exhaust gas is introduced into the cylinders of said first group 4 of cylinders in the heating mode. This will secure that the temperature of the gas introduced into the cylinders is not too high. The heat removed from the recirculated exhaust gas in the EGR-cooler can be transferred to the engine coolant.

As said before, the control device 6 is arranged to provide a higher proportion recirculated exhaust gas than inlet air to the first group 4 of cylinders in the heating mode. By means of the control unit 7 and the EGR valve 13 the flow of recirculated exhaust gas can be divided into a first flow of EGR to the first group 4 of cylinders and a second flow of EGR to the second group 5 of cylinders. For example, the flow to the second group cylinders can be cut and EGR can be provided to the first group cylinders only. In an alternative embodiment, a smaller amount of EGR can be provided to the working cylinders (i.e. second group cylinders) in order to further reduce the amount of inlet air as long as the combustion stability can be maintained.

In a conventional manner, the engine 2 (or the control device 6) can comprise another EGR valve 20, preferably arranged between the outlet manifold 12 and the EGR cooler 15, for regulating the total amount of recirculated EGR.

Since the inlet air flow to the first group cylinders is reduced in the heating mode in comparison to a mode where all cylinders are working cylinders, the control device 6 is preferably arranged to compensate for the limited or stopped inlet air flow by providing a corresponding flow of recirculated exhaust gas to the first group 4 of cylinders so as to avoid throttling of the gas flow.

The remaining parts of the engine can be designed by means of conventional components. For example, a turbo unit 21 such as a Variable Geometry Turbo (VGT) driven by the exhaust flow 22 can be used for compression of the inlet air 23. The inlet air 23 can then be cooled in a Charged Air Cooler (CAC) 24 before entering the air intake 10 of the inlet manifold 9.

Figure 2B:
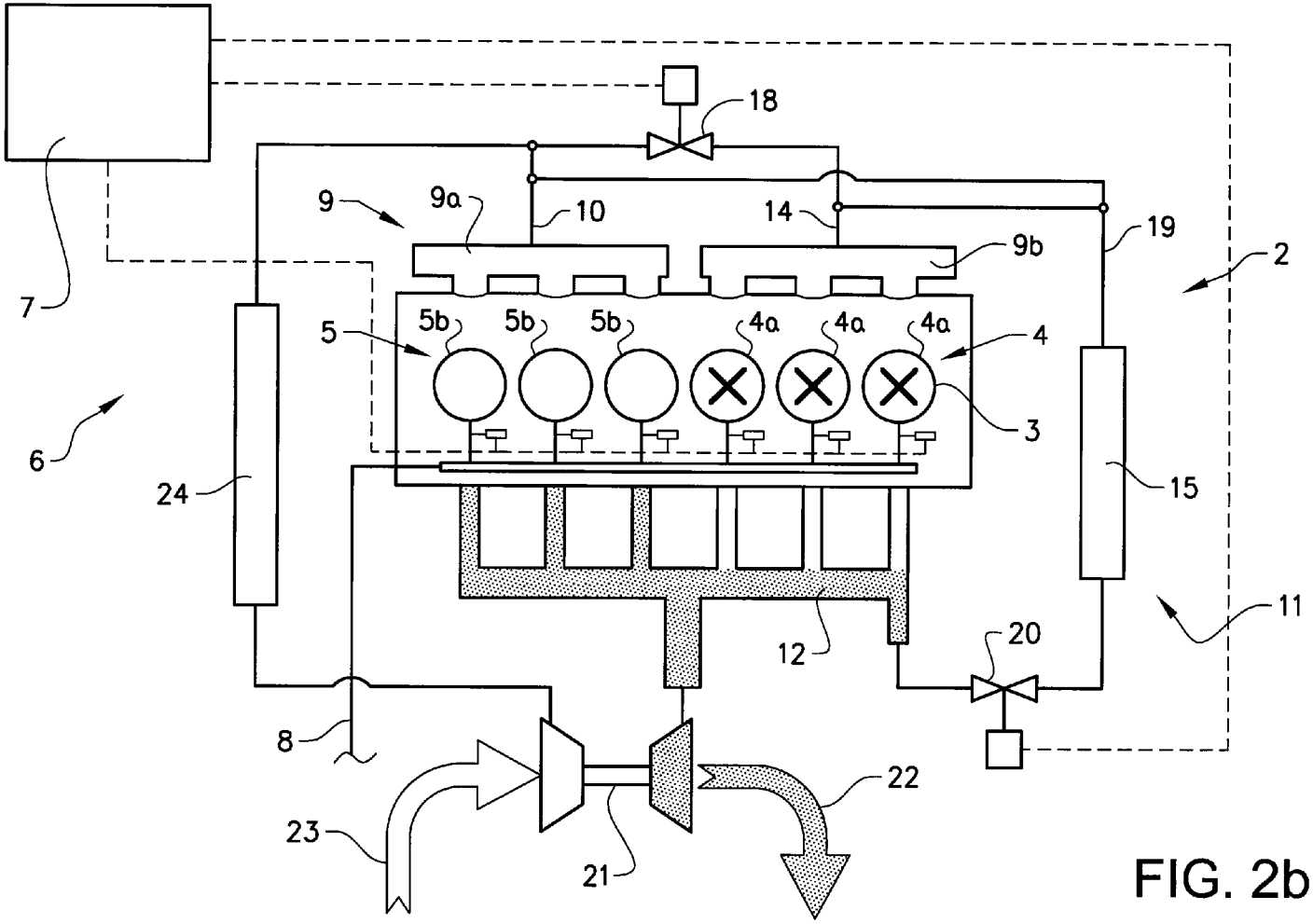
FIG. 2*b* is a schematic view of an alternative embodiment of the internal combustion engine according to the invention.

In FIG. 2*b* another example embodiment of the engine according to the invention is illustrated. For the embodiments of the engine according to the invention described with reference to FIG. 2*b*, only features and functions unique for these embodiments will be described in detail. Same reference numerals used in FIG. 2*b* as in FIG. 2*a* will indicate same or similar components as already described with reference to FIG. 2*a*, and hereinafter these components will only be briefly described or not described at all.

In the embodiment shown in FIG. 2*b*, an inlet manifold 9 is divided into two inlet manifold sections 9*a*, 9*b*, which means that the cylinders 3 are physically divided into a first group 4 and a second group 5 of cylinders. A valve 18 for limiting or preventing inlet air to the first group 4 of cylinders while allowing a flow of inlet air to the second group 5 of cylinders in the heating mode is arranged outside the manifold 9. An inlet air intake 10 of the inlet air manifold section 9*a* is arranged to provide inlet air to the cylinders 5*b* of the second group 5 and an inlet air intake 14 of the inlet air manifold section 9*b* is arranged to provide inlet air to the cylinders 4*a* of the first group 4. By means of the air valve 18 the air flow to the cylinders 4*a* of the first group 4 can be limited or cut, whereas the air flow to the cylinders of the second group 5 can be maintained. Additionally, the flow to the second group cylinders could also be controlled by any other means. Thus, the air flow to the second group cylinders can be regulated in a conventional way.

As appears from FIG. 2*b*, a pipe 19 for supplying EGR is connected to both the inlet air intake 10 of manifold section 9*a* and the inlet air intake 14 of manifold section 9*b*. Thus, in this embodiment the inlet air intake 14 is also an EGR intake. In the embodiment illustrated in FIG. 2*b* an EGR valve (denoted 13 in FIG. 2*a*) for dividing the flow of EGR into a first and a second flow to the first group of cylinders and second group of cylinders, respectively, can be omitted. As already described with reference to FIG. 2*a*, optionally the engine 2 (or the control device 6) can comprise an EGR valve 20, preferably arranged between an outlet manifold 12 of the engine and the EGR cooler 15, for regulating the total amount of recirculated EGR.

If not any valve for controlling the amount of EGR provided to the first group cylinders and the second group cylinders, respectively, is used, the proportion of EGR is regulated by the air valve 18. By limiting or preventing the inlet air flow to the first group cylinders by means of the air valve 18, a greater portion of EGR will reach these first group cylinders 4*a*. Accordingly, the control device 6 is arranged to adapt the adjustment of the air valve 18 so as to provide more recirculated exhaust gas than inlet air to the first group cylinders 4*a* in the heating mode.

Figure 3:
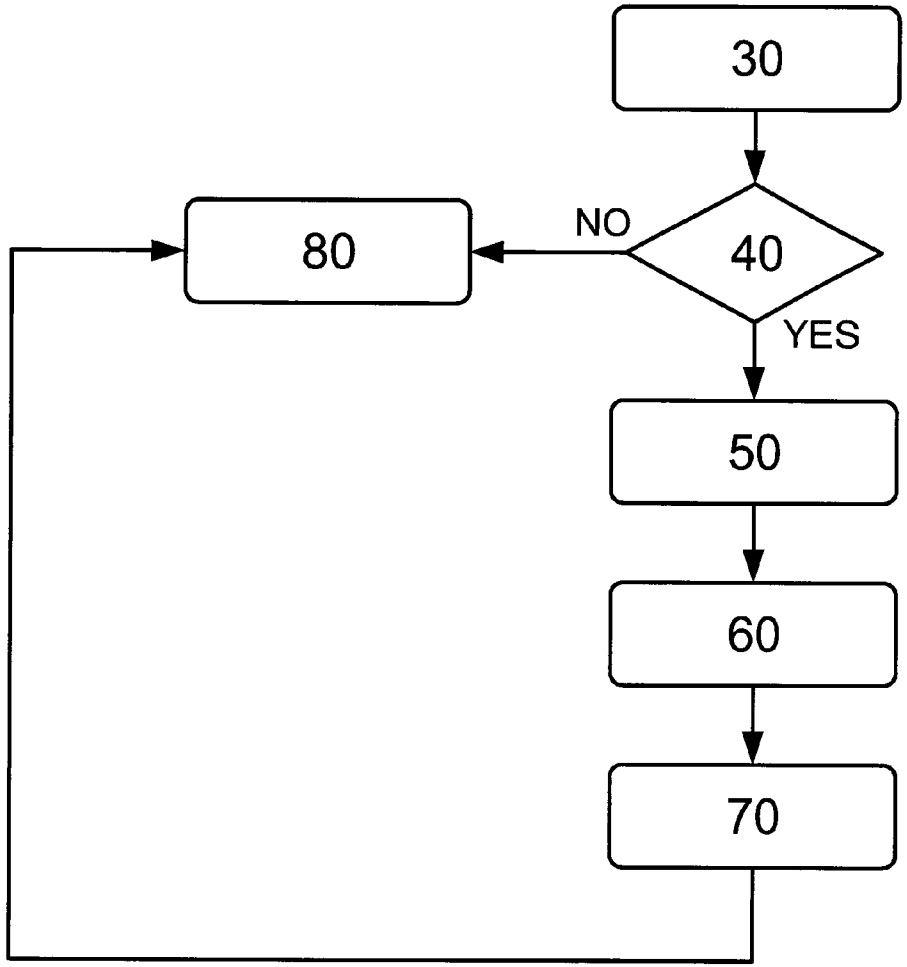
FIG. 3 is a flow chart showing a method according to the invention.

The method according to the invention is schematically illustrated by the flow chart in FIG. 3. The method comprises the steps of providing a heating mode 30 of an internal combustion engine having a first and a second group of cylinders, and if this heating mode is selected 40 either by the operator or automatically, deactivating 50 the first group of cylinders (while activating the second group of cylinders or maintaining the activation thereof), and the step 60 of providing a higher proportion recirculated exhaust gas than inlet air to the first group cylinders during the heating mode.

As already has been described hereinabove, deactivation of the first group cylinders can be performed by stopping the injection of fuel to the first group of cylinders. During the heating mode, a flow of inlet air to the first group of cylinders is limited or prevented while allowing a flow of inlet air to the second group of cylinders. In other words; in comparison to a mode where all cylinders are working cylinders, the inlet air flow to the first group of cylinders is preferably heavily reduced or stopped during the heating mode.

The injection of fuel to the second group of cylinders is preferably increased by an amount substantially equal to the amount by which the injection of fuel to the first group of cylinders is reduced in the heating mode. For example, when the fuel injection is stopped for half of the cylinders the fuel provided to the firing cylinders can be doubled. In other words; the load on the engine in the heating mode can be equal to the load when not in the heating mode during corresponding conditions by an increased injection of fuel into the working cylinders.

The heating mode can be finished 70 by a mode change, either performed manually by the operator or automatically when a certain engine/exhaust temperature has been reached, and then normal operation 80 of the engine can take place.

It should also be readily understood that the method described herein with reference to FIG. 3 may further implement any of the other features described hereinabove, particularly with reference to FIGS. 1, 2*a* and 2*b*.

With further reference to FIGS. 2*a* and 2*b*, according to a third aspect, the invention also relates to a control unit 7 for controlling an internal combustion engine. The control unit 7 is configured to provide a heating mode of the internal combustion engine where the first group 4 cylinders are deactivated and the second group 5 cylinders are activated. In the heating mode the control unit 7 is configured to provide a higher proportion recirculated exhaust gas than inlet air to the first group 4 cylinders. Such a control unit can use a computer program comprising program code means for performing the steps of the method according to the invention when said program is run on a computer. The computer program can be stored on the control unit or a computer readable medium connectable to the control unit.

As soon as the invention is disclosed, other parts of the internal combustion engine and/or the control unit can be designed by a person skilled in the art by using standard components, for example components for fuel injection, etc.

The invention can also be combined with other methods for raising the temperature, such as for example throttling of the gas flow at the inlet or exhaust side of the cylinders. Although throttling will lead to increased fuel consumption due to a pressure difference over the engine, in some cases it can be motivated in order to reach the requisite temperature.

It is to be understood that the present invention is not limited to the embodiments described above and illustrated in the drawings; rather, the skilled person will recognize that many changes and modifications may be made within the scope of the appended claims.

The invention claimed is:

1. An internal combustion engine having a plurality of cylinders, the internal combustion engine being provided with an arrangement for exhaust gas recirculation, the plurality of cylinders being divided into a first group and a second group of cylinders, the internal combustion engine having a control device arranged to provide a heating mode of the internal combustion engine where the first group cylinders are deactivated and the second group cylinders are activated, wherein, in the heating mode the control device is arranged to provide more recirculated exhaust gas than inlet air to the first group cylinders, wherein the control device comprises an EGR valve such that a flow of recirculated exhaust gas can be divided into a first flow of EGR to the first group of cylinders and a second flow of EGR to the second group of cylinders.

2. An internal combustion engine according to claim 1, wherein in the heating mode the control device is arranged to provide more than 60% recirculated exhaust gas and less than 40% inlet air to the first group cylinders.

3. An internal combustion engine according to claim 1, wherein in the heating mode the control device is arranged to provide more than 70% recirculated exhaust gas and less than 30% inlet air to the first group cylinders.

4. An internal combustion engine according to claim 1, wherein in the heating mode the control device is arranged to provide more than 80% recirculated exhaust gas and less than 20% inlet air to the first group cylinders.

5. An internal combustion engine according to claim 1, wherein in the heating mode the control device is arranged to provide more than 90% recirculated exhaust gas and less than 10% inlet air to the first group cylinders.

6. An internal combustion engine according to claim 1, wherein in the heating mode the control device is arranged to provide more than 95% recirculated exhaust gas and less than 5% inlet air to the first group cylinders.

7. An internal combustion engine according to claim 1, wherein the internal combustion engine is a compression-ignition engine.

8. An internal combustion engine according to claim 7, wherein the internal combustion engine is a diesel engine.

9. An internal combustion engine according to claim 1, wherein the internal combustion engine is a lean burn engine.

10. An internal combustion engine according to claim 1, wherein the control device comprises a valve for limiting or preventing a flow of inlet air to the first group of cylinders while allowing a flow of inlet air to the second group of cylinders in the heating mode.

11. An internal combustion engine according to claim 10, wherein the internal combustion engine has an inlet air manifold for providing air to the plurality of cylinders, and the valve for limiting or preventing a flow of inlet air to the first group of cylinders is arranged inside the inlet air manifold (g) for dividing the cylinders into the first group and the second group of cylinders.

12. An internal combustion engine according to claim 1, wherein the internal combustion engine has a cooler for cooling the recirculated exhaust gas before the recirculated exhaust gas is introduced into the cylinders of the first group of cylinders in the heating mode.

13. A vehicle provided with an internal combustion engine according to claim 1.

14. A method for controlling an internal combustion engine, the engine having a plurality of cylinders and being provided with an arrangement for exhaust gas recirculation, the plurality of cylinders being divided into a first group and a second group of cylinders, the arrangement comprising an EGR valve adapted to divide flow of recirculated exhaust gas into a first flow of EGR to the first group of cylinders and a second flow of EGR to the second group of cylinders, the method comprising providing a heating mode of the internal combustion engine where the first group cylinders are deactivated and the second group cylinders are activated, and operating the EGR valve in order to provide more recirculated exhaust gas than inlet air to the first group cylinders and also control flow of recirculated exhaust gas to the second group of cylinders in the heating mode.

15. A computer comprising a program for performing the steps of claim 14 when the program is run on the computer.

16. A non-transitory computer readable medium comprising a computer program for performing the steps of claim 14.

17. A control unit for controlling an internal combustion engine, the internal combustion engine having a plurality of cylinders and being provided with an arrangement for exhaust gas recirculation, the plurality of cylinders being divided into a first group and a second group of cylinders, the arrangement comprising an EGR valve adapted to divide flow of recirculated exhaust gas into a first flow of EGR to the first group of cylinders and a second flow of EGR to the second group of cylinders, the control unit being configured to provide a heating mode of the internal combustion engine where the first group cylinders are deactivated and the second group cylinders are activated, wherein in the heating mode the control unit is configured to provide more recirculated exhaust gas than inlet air to the first group cylinders by operating the EGR valve and also control flow of recirculated exhaust gas to the second group of cylinders.

* * * * *